US012336618B2

(12) United States Patent
Kim et al.

(10) Patent No.: US 12,336,618 B2
(45) Date of Patent: Jun. 24, 2025

(54) APPLICATOR FOR MAKEUP PRODUCT

(71) Applicant: Kiss Nail Products, Inc., Port Washington, NY (US)

(72) Inventors: Tae Kim, Port Washington, NY (US); Siyong Sung, Port Washington, NY (US); Sung Youl Kim, Port Washington, NY (US)

(73) Assignee: Kiss Nail Products, Inc., Port Washington, NY (US)

( * ) Notice: Subject to any disclaimer, the term of this patent is extended or adjusted under 35 U.S.C. 154(b) by 0 days.

(21) Appl. No.: 18/514,885

(22) Filed: Nov. 20, 2023

(65) Prior Publication Data

US 2024/0090647 A1 Mar. 21, 2024

Related U.S. Application Data

(60) Division of application No. 16/453,685, filed on Jun. 26, 2019, now abandoned, which is a (Continued)

(51) Int. Cl.

| | |
|---|---|
| ***A45D 2/48*** | (2006.01) |
| ***A45D 44/02*** | (2006.01) |
| *A41G 5/02* | (2006.01) |

(52) U.S. Cl.

CPC ..... *A45D 44/02* (2013.01); *A45D 2/48* (2013.01); *A41G 5/02* (2013.01); *A45D 2200/10* (2013.01)

(58) Field of Classification Search

CPC ..... A45D 2/00; A45D 2/48; A45D 26/0066; A45D 26/0071; A45D 29/02; (Continued)

(56) References Cited

U.S. PATENT DOCUMENTS 3,625,229 A * 12/1971 Silson ..... A41G 5/02 132/216
4,993,439 A 2/1991 Davies
(Continued)

FOREIGN PATENT DOCUMENTS

CN 205848988 U 8/2018
GB 1307107 A 2/1973
(Continued)

OTHER PUBLICATIONS

Korean Patent Office, KR 10-2020-045111 Office Action.
(Continued)

*Primary Examiner* — Rachel R Steitz
*Assistant Examiner* — Karim Asqiriba
(74) *Attorney, Agent, or Firm* — Cherskov Flaynik & Gurda, LLC

(57) ABSTRACT

An applicator for applying magnetic eyelashes is provided. The applicator includes a first leg with a first proximal end and a first distal end; a second leg with a second proximal and a second distal end; a first holder provided at the first distal end and including a first side; and a second holder provided at the second distal end and including a second side facing the first side. The first leg and the second leg are pivotally attached to each other so that the applicator is able to switch between an open state where the first side and the second side are spaced and a closed state where the first side and the second side are contacted with each other. The first side and second side are curved. Each of the first and second applicators is slidable relative to the corresponding leg.

11 Claims, 12 Drawing Sheets

Related U.S. Application Data continuation-in-part of application No. 16/384,711, filed on Apr. 15, 2019, now abandoned.

(58) Field of Classification Search

CPC .. A45D 29/023; A45D 29/18; A45D 2200/10; A41G 5/02; B25B 9/00; B25B 9/02; B25B 9/04

See application file for complete search history.

(56) References Cited

U.S. PATENT DOCUMENTS

| | | | | |
|---|---|---|---|---|
| 5,097,598 | A | 3/1992 | Andreula | |
| 5,307,826 | A * | 5/1994 | Iosilevich | A45D 2/48 132/218 |
| 8,424,542 | B1 | 4/2013 | Han | |
| 2005/0166939 | A1 | 8/2005 | Stroud | |
| 2009/0217939 | A1 | 9/2009 | Rabe et al. | |
| 2009/0255548 | A1* | 10/2009 | Lin | A45D 2/48 132/217 |
| 2010/0096871 | A1* | 4/2010 | Ait-Mani | G04D 1/021 294/99.2 |
| 2012/0160259 | A1* | 6/2012 | Nguyen | A41G 5/02 132/216 |
| 2016/0206031 | A1 | 7/2016 | Stoka | |
| 2018/0098591 | A1* | 4/2018 | Leeflang | A41G 5/0086 |
| 2018/0235298 | A1 | 8/2018 | Zhao | |
| 2018/0352886 | A1 | 12/2018 | Schroeder | |
| 2020/0128896 | A1 | 4/2020 | Bougie et al. | |

FOREIGN PATENT DOCUMENTS

| | | | |
|---|---|---|---|
| GB | 2571164 | A | 8/2018 |
| JP | 3007329 | U | 2/1995 |
| JP | 2011500979 | A | 1/2011 |
| WO | WO2016153773 | A1 | 9/2016 |

OTHER PUBLICATIONS

Youtube video by user Corrie V, available online at https://www.youtube.com/watch?v=3XsiW6YQGDY, published on Nov. 16, 2018.

Amazon product page for Ardell Magnetic Lash Applicator, available online at https://www.amazon.co.uk/Ardell-Magnetic-Lash-Applicator/dp/B07H7ZQ92R/ref=asc dated Feb. 18, 2019.

UK Intellectual Property Office, Application No. GB2005049.8 Search Report date of search Sep. 21, 2020.

UK Intellectual Property Office, Application No. GB2005049.8 Office Action mailed on Jun. 23, 2023.

* cited by examiner

APPLICATOR FOR MAKEUP PRODUCT

CROSS-REFERENCE TO RELATED APPLICATIONS

This utility application claims the benefit of priority as a divisional of U.S. patent application Ser. No. 16/453,685, filed on Jun. 26, 2019 and currently pending, which is in turn a continuation in part of U.S. patent application Ser. No. 16/384,711, filed on Apr. 15, 2019, which has been abandoned, both of which are incorporated herein by reference.

BACKGROUND OF THE INVENTION

1. Field of the Invention

The field of the invention is an applicator for applying a makeup product, and more particularly but not exclusively, the artificial eyelashes, especially magnetic eyelashes.

2. Background of the Invention

Artificial or false eyelashes have been favored as a means to enhance the length, curliness, fullness, and thickness of natural eyelashes. Such artificial eyelashes are normally made of a lash line strip with hair made from materials including mink, synthetic, horse hair, and in some instances, human hair. In the past, the artificial eyelashes were adhered to a natural lash with adhesive glue. Recently, a type of magnetic eyelashes provided with visually invisible magnets along the lash line became popular. A typical magnetic eyelash comprises an upper eyelash strip and an under eyelash strip both provided with tiny magnets and thus capable of locking together by the magnetic force. When using, a user may sandwich the natural eyelashes between the upper eyelash strip and the under eyelash strip hold together with magnetic force along the natural lash line. When removing the magnetic eyelashes, the user can gently pull the strips apart.

Compared with the adhesive type of artificial eyelashes, the magnetic eyelashes can be applied and removed easily and can be reused. However, applying the magnetic eyelash still takes time. A user needs to lay the upper eyelash strip across the top of a natural lash line with a hand or a tool like tweezers. Then, the user shall place the under eyelash strip underneath the natural lash line so that it will lock in place with the upper eyelash strip. Prior art also provides a specific tool similar to tweezers for applying the magnetic eyelashes. However, these methods and tools still have drawbacks. It is difficult for a user to load the eyelashes and to release them at the intended locations. The eyelashes may not be fully attached to the lash line.

A need exists in the art for a means that can simplify the application of the magnetic eyelashes. A need also exists for a means which facilitate a user to easily and precisely place the magnetic eyelashes in place.

SUMMARY OF THE INVENTION

An object of the invention is to create an applicator for magnetic eyelashes that overcomes many of the drawbacks in the prior art. A feature of the invention is that the applicator comprises two legs each with a holder for holding a magnetic eyelash strip and the holder comprises a side for detachably attaching the magnetic eyelash which is curved corresponding to a natural lash line. An advantage of the invention is that the eyelash strips can fully adhere to the holder and thus can be easily and fully attached to a natural lash line. In one embodiment, each of the sides comprised by the holders may further comprise a groove. A further advantage of the invention is that the eyelash strips can be adequately and stably attached to the holder with an increased contact area with the holder through the groove. In a further embodiment, the side may extend along the whole length of the corresponding side.

A further object of the invention is to provide an applicator that allows for a user to easily deliver the magnetic eyelash strips to an intended position. A feature of the invention, in one embodiment, is that the first holder and the second holder are substantially transparent. An advantage of the invention is that the user will have a better view of the position of the eyelash strips attached on the holders through a mirror when applying the eyelash strips with the applicator. In one embodiment, the first and second holders are made of silicone.

Another object of the invention is to facilitate the user in the operation of the applicator. A feature of the invention is that each of the first and second holders is attached to the corresponding one of the first and second legs through a hinge so that each holder is capable of pivoting around the hinge. Another feature of the invention is each of the holders is provided with a sliding groove that is engaged with a pin provided on the corresponding one of the first and second sides, so that each holder is able to slide relative to the corresponding leg. An advantage of the invention is that the user can turn the holders to an angular position relative to the legs so that the user may easily hold and operate the applicator while the legs will not block the view of the holder through the mirror. In one embodiment, the hinges function in a stepped manner. In another embodiment, the hinges may function in a continuous manner.

Another object of the invention is to facilitate the alignment of the upper and under magnetic eyelash strips. A feature of the invention is that a mark is provided on the corresponding holder for aligning with a corresponding mark on the corresponding magnetic eyelash strip. An advantage of the invention is that the user may align the upper and under eyelash strips by aligning each of them with the corresponding holder with the aid of the marks. In one embodiment, each of the marks may be provided at a center position in the extending direction of the corresponding one of the first and second sides.

Yet another object of the invention is to facilitate the operation of the applicator to hold and apply the magnetic eyelash strips. A feature of one embodiment is that a layer made of a ferromagnetic material is provided on the corresponding one of the first and second sides. An advantage of one embodiment is that the layer can detachably and securely attach the magnetic eyelash strip with a magnetic force. In one embodiment, each of the layer comprises a strip. In another embodiment, at least one of the layers comprises one or more sections arranged on the corresponding one of the first and second sides. In further another embodiment, the layers can be provided in the grooves that are provided in the corresponding sides of the holders.

Another object of the invention is to provide an applicator which can be easily operated by the user. A feature of one embodiment is that the first leg and the second leg are pivotally attached with each other through a hinge or a leave spring. A benefit of the invention, in one embodiment, is that the applicator can switch from an opened state where the first and second sides are spaced from each other to a closed state where the first and second sides are contacted with each other by an appropriate force exerted by the user.

Another object of the invention is to provide an applicator which is adjustable to various users. A feature of one embodiment is that the first side and the second side are adjustable in curvature. In one example, the first and second side comprises a flexible material such as silicon, plastics, or metal, among the other. A benefit of the invention is that the first and second sides are adjustable to the shape of natural lash lines.

An applicator is disclosed comprising: a first leg comprising a first proximal end and a first distal end; a second leg comprising a second proximal and a second distal end; a first holder provided at the first distal end and comprising a first side; and a second holder provided at the second distal end and comprising a second side facing the first side; wherein the first leg and the second leg are pivotally attached to each other so that the applicator is able to switch between an open state where the first side and the second side are spaced and a closed state where the first side and the second side are contacted with each other; the first side and second side are curved; the first holder is provided with a first sliding groove; the first leg is provided with a first pin at the first distal end that is engaged with the first sliding groove so that the first holder is able to slide relative to the first leg; the second holder is provided with a second sliding groove; and the second leg is provided with a pin at the second distal end that is engaged with the second sliding groove so that the second holder is able to slide relative to the second leg.

BRIEF DESCRIPTION OF DRAWINGS

The invention together with the above and other objects and advantages will be best understood from the following detailed description of the preferred embodiment of the invention shown in the accompanying drawings, wherein:

FIGS. 7A-7F depict views of another embodiment of the invention, wherein FIG. 7A is a exploded view, FIG. 7B is a top view, FIG. 7C is a front view, FIG. 7D is a perspective view, FIG. 7E is an enlarged view of the circle E in FIG. 7D, and FIG. 7F is an enlarged view of the circle F in FIG. 7D;

DETAILED DESCRIPTION OF THE INVENTION

In various embodiments, the invention provides an applicator for applying magnetic eyelashes. The magnetic eyelashes comprises an upper eyelash strip and an under eyelash strip both provided with tiny magnets and thus capable of locking together by the magnetic force.

In one embodiment, the invention comprises an applicator comprising: a first leg comprising a first proximal end and a first distal end; a second leg comprising a second proximal and a second distal end; a first holder provided at the first distal end and comprising a first side; and a second holder provided at the second distal end and comprising a second side facing the first side; wherein the first leg and the second leg are pivotally attached to each other so that the applicator is able to switch between an open state where the first side and the second side are spaced and a closed state where the first side and the second side are contacted with each other; and the first side and second side are curved.

The foregoing summary, as well as the following detailed description of certain embodiments of the present invention, will be better understood when read in conjunction with the appended drawings.

As used herein, an element or step recited in the singular and proceeded with the word "a" or "an" should be understood as not excluding plural said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

Figure 1:
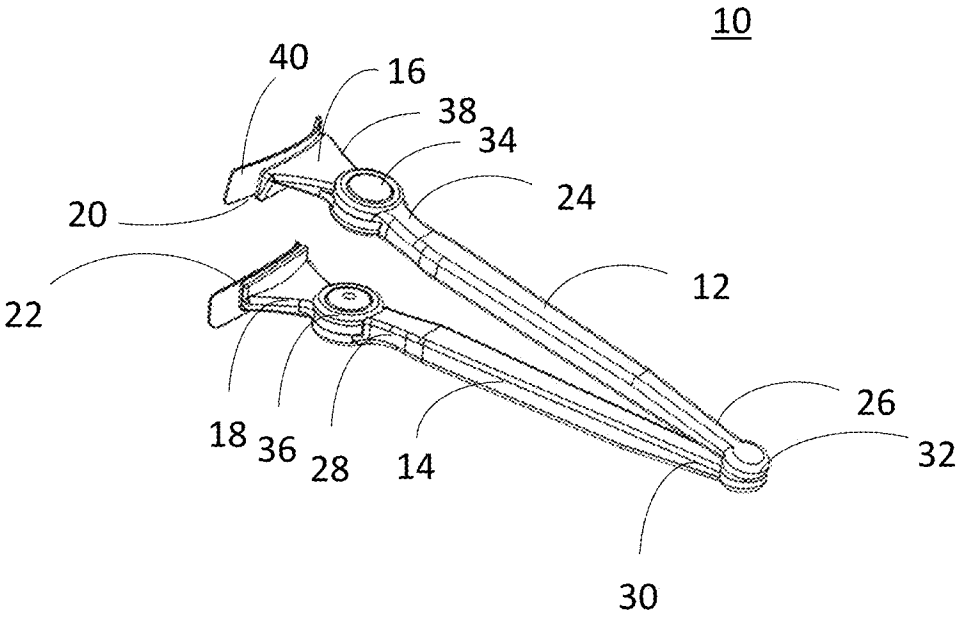
FIG. 1 depicts a perspective view of one embodiment of the invention.
Figure 2B:
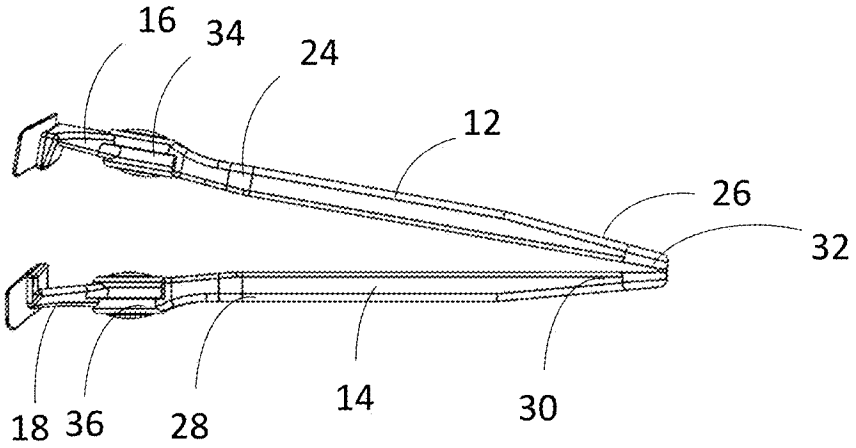
FIGS. 2A and 2B depict a side view and a front view of one embodiment of the invention when the applicator is in an open state where there is no force applied.
Figure 2A:
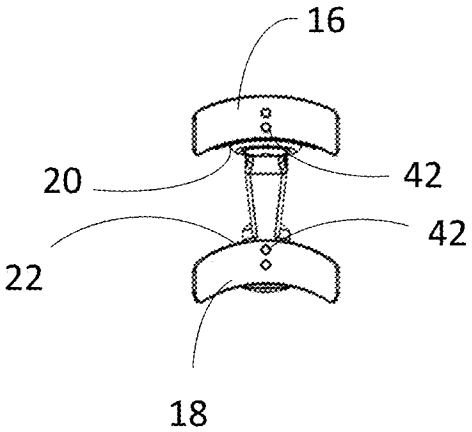
Figure 3C:
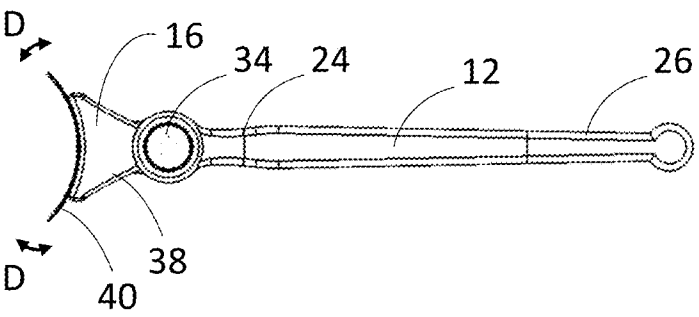
FIGS. 3A, 3B and 3C depict a side view, front view, and top view of one embodiment of the invention when the applicator is in a closed state where a force is applied.
Figure 3B:
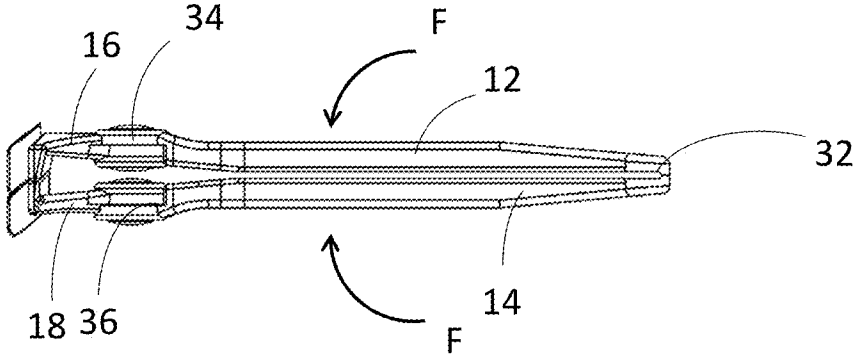
Figure 3A:
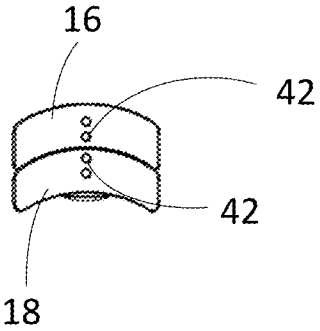

Turning to the figures, FIG. 1 depicts a perspective view of one embodiment of the invention. FIGS. 2A and 2B depict a side view and a front view of one embodiment of the invention when the applicator is in an open state where there is no force applied. FIGS. 3A, 3B, and 3C depict a side view, front view, and top view of one embodiment of the invention when the applicator is in a closed state where a force is applied.

As shown in FIGS. 1-3C, the applicator 10 generally appears like a pair of tweezers. The applicator 10 comprises a first leg 12 and a second leg 14. A first holder 18 comprising a first side 20 is attached to the distal end 24 of the first leg 12, while a second holder 20 comprising a second side 22 facing the first side 20 is attached to the distal end 28 of the second leg 14. The first and second holders 16 and 18 are adapted to hold the magnetic eyelash strips with the first and second sides 20 and 22, which will be explained below. The first leg 12 and the second leg 14 are attached together through a leaf spring 32 at their respective proximal ends 26 and 30. The elasticity of the spring 32 allows the first leg 12 pivot around the leaf spring 32 relative to the second leg 14, so that the applicator 10 may switch between an open state where the first and second sides 20 and 22 are spaced from each other and a closed state where the first and second sides are in contact. Therefore, the applicator 10 appears like a tweezer. However, in other embodiments, the first and second legs may be hinged at other positions than the proximal ends. In these cases, applicator 10 may resemble a pivoted tool such as a pair of scissors.

The first and second legs 12 and 14 may be made of any of synthetic material, metal, wood, and the combination thereof, among others. For example, the first and second legs 12 and 14 may be made of metal covered with silicon. In one embodiment, the components of the applicator 10 comprise a non-reactive metal such as stainless steel or aluminum so as to facilitate disinfection after use.

As shown in FIGS. 1-2B, the proximal end 26 of the first leg 12 and the proximal end 30 of the second leg 14 are attached to each other through a leaf spring 32. The leaf spring 32 is formed into a "V" or "U" shape. The respective ends of the leaf spring 32 are fixed to the proximal ends 26 and 32, respectively. The leaf spring 32 may be made of any appropriate material, for example, any of synthetic materials, metals, wood, and the combination thereof, among the others. Due to the elasticity of the leaf spring 32, the first leg 12 is capable of pivoting relative to the second leg 14, so that the applicator 10 is switchable between an opened state where the first holder 16 and second holder 18 are spaced apart from each other and a closed state where the first holder 16 and second holder 18 are in contact. More specifically, in the open state, as shown in FIGS. 2A and 2B, a first side 20 of the first holder 16 and a second side 22 of the second holder 18 that is facing the first side 20 are spaced from each other. In the closed state, as shown in FIGS. 3A and 3B, under the force F shown by the arrows exerted on the legs 12 and 14, the first side 20 and the second side 22 come into contact with each other.

In another embodiment, the first and second legs 12 and 14 may be formed integrally at their proximal ends 26 and 30, and may pivot relative to each other due to the elasticity of the thus formed structure. In a further embodiment, the first and second legs 12 and 14 may be attached to each other through a hinge instead of the leaf spring 32. In such embodiments, the first and second legs 12 and 14 may be attached to each other through a hinge at their proximal ends or at other places, for example, midway between their two respective ends.

In one embodiment as shown in FIGS. 1-3C, the first holder 16 comprises a bracket 38 and a plate 40. One end of the bracket 38 is attached to the distal end of the first leg 12 while the other end of the bracket 38 is attached with a plate 40. The first side 20 is an edge of the plate 40. The plate 40 is curved so that the first side 20 of the plate 40 is curved substantially corresponding to a natural lash line. In addition, the side 20, i.e. the plate 40 in this case, is flexible. The user may bend the plate 40 in the directions as shown by arrows D in FIG. 3C. Thus, the side 20 is adjustable to the shape of natural lash lines. In order to increase the flexibility of the side 20, the plate 40 is fixed to the bracket 38 at a part of the plate 40, for example, only at the center of the plate 40. FIG. 5A shows an example where the plate 40 is attached to the bracket 38 only at the center of the plate 40 through engagement of the perforations 70 on the plate 40 and pins 68 on the bracket 38. The plate 40 may be fixed to the bracket 38 by other means, such as adhesive, welding, and press fitting, among the others. The second holder 18 is formed symmetrically to the first holder 16, so that the second side 22 faces to the first side 20 and is also curved substantially corresponding to a natural lash line. This may greatly facilitate the loading of eyelashes precisely and closely to the natural lash line as intended. In other embodiments, each of the first and second holders does not necessarily comprise a bracket and a plate and does not have to be symmetrical, as long as a first side of the first holder and a second side of the second holder that face to each other are both curved corresponding to a natural lash line and may come into contact with the pivoting of the first leg relative to the second leg. For example, the bracket may be formed into other shapes than the shape shown in the figures, such as oval, triangle, and sector, among the others. In addition, the plate may be formed integrally with the bracket. In this case, the end of bracket can be formed as the plate. Furthermore, the width of the plate is not limited. It can be formed as thin as a rod, as long as it comprises a side that curved substantially corresponding to a natural lash line.

The first and second holders 16 and 18 may be made of any of synthetic material, metal, wood, and a combination thereof, among others. In one embodiment, the holders 16 and 18 are made of silicon. The artificial eyelashes thus may be reversibly attached to the holders, more specifically, the first and second sides 20 and 22 due to the friction and adhesiveness from the silicon holders. Silicon also has good biocompatibility so that it will not irritate users' skin. In another embodiment, the holders 16 and 18 are made of transparent materials, for example, substantially transparent silicon. In this case, the users will be able to clearly see the position of the artificial eyelashes even through the mirror when operating the applicator by themselves. In further another case, the holders may be made of a combination of materials. For example, the holders may be made of metal rods covered with transparent silicon. In this case, the holders are substantially transparent with improved strength.

In one embodiment, the length of the first side 20 is similar to that of the second side 22. The length of the first and second sides is greater than the artificial eyelashes, so as to prevent the outer or inner corner of the eyelashes to flare out after application. The length of the first and second sides may be for example, at least 1 inch.

Figure 4A:
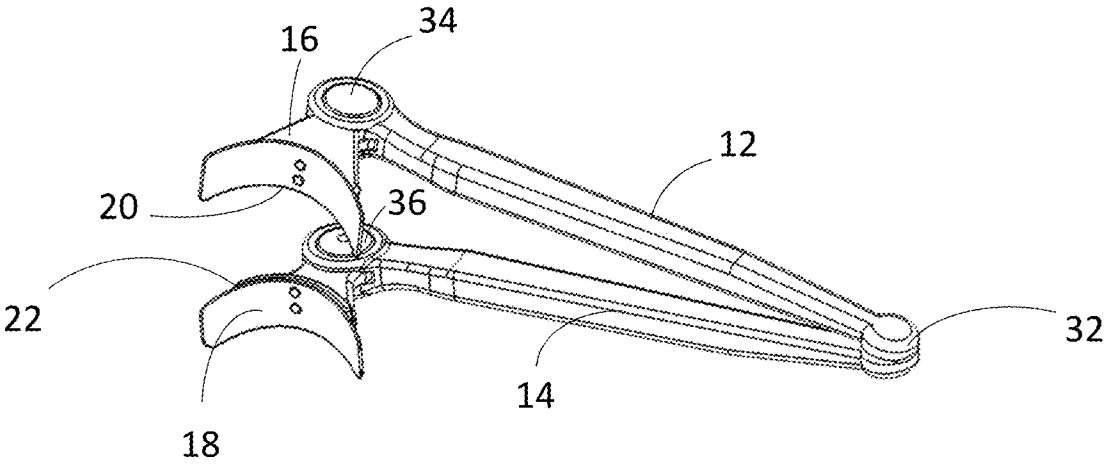
FIGS. 4A and 4B depict a perspective view and a top view of one embodiment of the invention where the first and second holders are turned for about 90 degrees relative to the first and second legs.
Figure 4B:
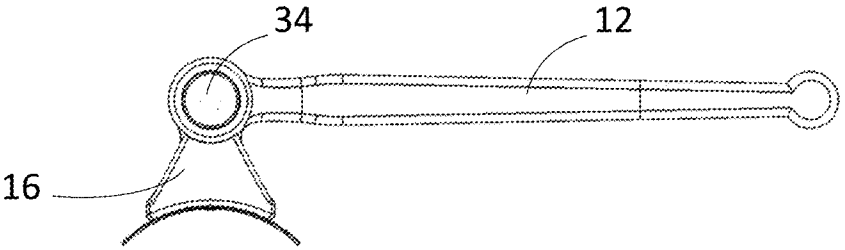

In one embodiment as shown by FIGS. 1-3C, the first holder 16 is attached to the first leg 12 through a hinge 34, so that the first holder 16 is capable of pivoting around the hinge 34 relative to the first leg 12. Similarly, the second holder 18 is attached to the second leg 14 through a hinge 36, so that the second holder is capable of pivoting around the hinge 36 relative to the second leg 14. FIGS. 4A and 4B show a perspective view and a top view of the applicator 10 where the first and second holders are turned for about 90 degrees relative to the first and second legs. By turning the holders to an angle, the user may get closer to a mirror without the view being blocked by the legs of the applicator. Therefore, it makes it easier for the user to apply the eyelashes.

The angle that the holders can pivot relative to the legs is not limited. For example, the holder may pivot relative to the legs no more than 180 degrees, or 120 degrees, or 90 degrees, or even less.

In one embodiment, the hinges 34 and 36 allow the respective holders 16 and 18 to pivot around the corresponding hinges relative to the corresponding legs in a stepped manner. It requires a force of more than a predetermined amount to turn the holders relative to the legs into a plurality of predetermined angular positions. At each of the predetermined angular positions, the holders are kept fixed relative to the legs without a force exerted.

Figure 5B:
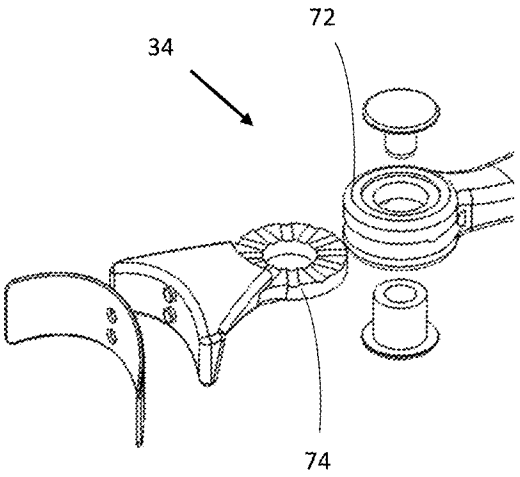
FIGS. 5A and 5B depict exploded views of two examples of the stepped hinge.
Figure 5A:
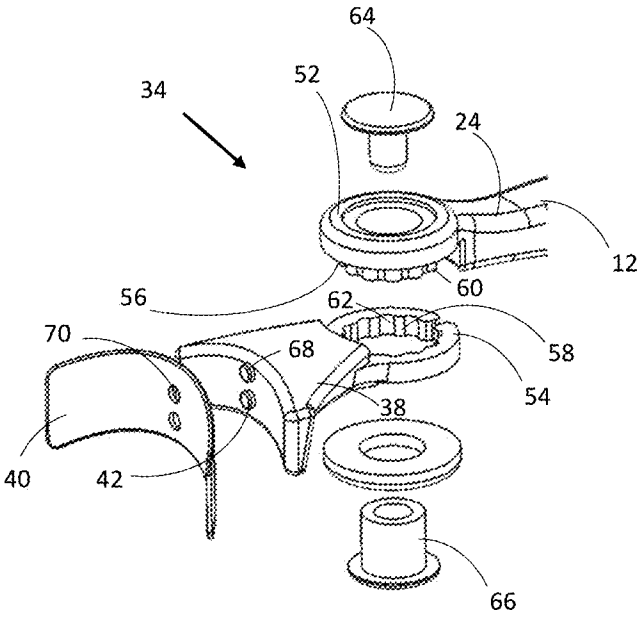

FIGS. 5A and 5B show exploded views of two examples of the structure of the stepped hinge. In FIGS. 5A and 5B, only examples of the first hinge 34 are shown, as the second hinge can be similarly designed.

FIG. 5A shows an expanded view of a first example of the stepped hinge 34. As shown by FIG. 5A, the hinge 34 comprises a first annular part 52 fixedly provided on the distal end 24 of the first leg 12 and a second annular part 54 fixedly provided on one end of the first holder. A plurality of protrusions 60 are evenly provided on an outer cylindrical surface 56 of the first annular part 52. A corresponding plurality of grooves 62 are evenly provided on an inner cylindrical surface 58 of the second annular part 54, so that the first annular part 52 engages with the second annular part 54 through the engagement of each protrusion 60 with a corresponding groove 62. The pin 64 goes through the center of the first and second annular parts and is fixed to the pin receptacle 66. Under a turning force that is more than a predetermined amount, the first annular part 52 is moved relative to the second annular part 54, and each protrusion 60 is disengaged with the corresponding groove 62. When the first annular part 52 is further moved, each protrusion 60 comes into engagement with a next groove 62. In this way, the first holder 16 may pivot around the hinge 34 relative to the first leg 12 in a stepped manner.

FIG. 5B shows an exploded view of a second example of the stepped hinge 34. The second example shown in FIG. 5B is the same as the first example, except that the protrusions and grooves are provided on the end surfaces of the first annular part 72 and the second annular part 74 instead of the cylindrical surfaces. Thus, the first and second annular part 72 and 74 are engaged with each other through their end surfaces.

In another embodiment (not shown), the hinges of applicator through which the holders are attached to the legs may function in a stepless manner. The holder may be turned to and stopped at any angle between its turning limits. In this case, for example, the hinge may comprise a first and second annular parts that engage with each other through friction. In further another embodiment, the applicator does not comprise the hinges at all. The holders are fixed or integrally formed with the legs.

In addition, in one embodiment, the first and second holders comprise marks 42, as shown in FIGS. 2A and 3A. Each of the marks 42 is provided near the corresponding side 20 or 22, and at the application starting position along the extending direction of the corresponding side 20 or 22. The marks 42 can be used to facilitate a user to place the magnetic eyelash strip precisely onto the corresponding holder. The magnetic eyelash comprises an upper and under eyelash strips. The upper and under eyelash strips must be aligned and attached with each other to form a complete artificial eyelash. Only when each eyelash strips are placed at the right positions on the corresponding holder, the eyelash strips will form the intended eyelash without misalignment. The upper and under eyelash strips should comprise corresponding marks, so that the user may only need to ensure that the mark on the eyelash strip is aligned with the mark on the corresponding holder. In this embodiment, since the marks 42 are provided at the center of the sides 20 and 22, the eyelash strips may not necessarily be provided with corresponding marks. The user may align the substantial center of the eyelash strip with the corresponding mark 42 when attaching the eyelash strip onto the corresponding side 20 or 22 of the holder. In another embodiment, the position of a mark along the extending direction of the side of the holder may be at another position other than the center.

As shown in FIGS. 5A and 5B, the mark 42 on the first holder 24 is formed by one of the two pins 68 on the bracket 38. The pins 68 are engaged with corresponding holes on the plate 40 so as to attach the plate 40 onto the bracket 38. In another embodiment, the marks 42 can be formed differently. For example, the marks can be a colorized block or pattern formed on the holder. The marks can also be formed by a concaved or convex part or a pattern on the holder.

Applicator Operations

Below, a brief explanation about how the applicator is used to attach the magnetic eyelashes onto the natural lash line is provided.

In an open state of the applicator as shown by FIGS. 2A and 2B, the user may attach the upper eyelash strip onto the first side 20 of the first holder 16 and the under eyelash strip onto the second side 22 of the second holder 18. The eyelash strips can be attached to the first and second side due to the friction and/or the adhesiveness provided by the material of the holder, such as silicone, plastic, metal or any combination thereof. Then the user may hold the applicator at the first and second legs, and move the applicator with the eyelash strips closer to the face, so that the natural lash line is close to and between the first and second sides 20 and 22. The user may then exert a force onto the first and second legs 12 and 14 as shown in FIG. 3B. At the same time, the user may adjust the position of applicator towards or from the face as need, so as to make the first and second sides 20 and 22 come closer to the natural lash line. When the applicator comes into a closed state as shown in FIGS. 3A and 3B or when the first and second sides 20 and 22 come close enough, the upper and under eyelash strips will snap tighter by the magnetic force between the strips with the natural lash line sandwiched between the upper and under eyelash strips.

During this operation, the user may turn the holders 16 and 18 around the hinges 34 and 36 at any time to a position that makes the user operate comfortably. The user may also adjust the first and sides 20 and 22 to the shape of natural lash lines at any time.

Alternative Embodiments

Ferromagnetic Layer

Figure 6B:
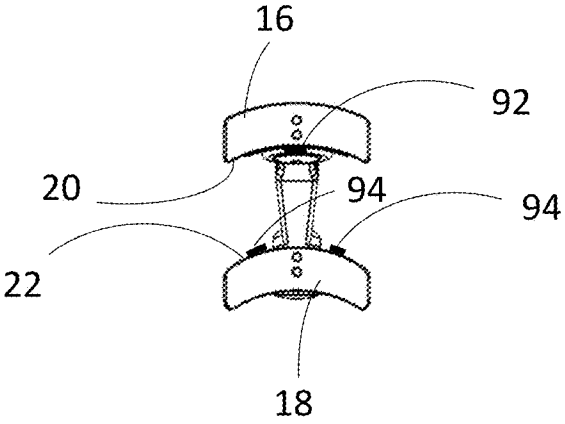
FIGS. 6A and 6B depict front views of two examples of the ferromagnetic layer provided on the holders.
Figure 6A:
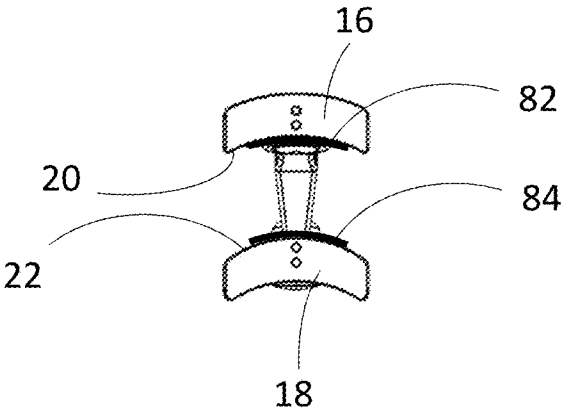

Another embodiment is designed to provide a layer made of ferromagnetic material at each of the first and second sides of the respective holders. The ferromagnetic material may be one from the group comprising but not limited to iron, nickel, cobalt, and their alloy, and some compounds of rare earth metals. As shown in FIG. 6A, the layer at the first side comprises a first strip 82 provided on the first side 20 of the first holder 16, while the layer at the second side comprises a second strip 84 provided on the second side 22 of the second holder 18. The strips 82 and 84 are made of a ferromagnetic material so that the magnetic eyelash strips can be detachably attached to the first and second sides. In the example shown by FIG. 6A, each strip 82 or 84 extends over part of the length of the corresponding side 20 or 22. However, in another embodiment, the strip 82 or 84 may extend over all the length of the corresponding side 20 or 22. In another example, as shown by FIG. 6B, the layer comprises one or more sections 92 or 94 provided on the corresponding sides. The applicator 100 as shown by FIG. 7A and other figures, which will be discussed below, also comprises a magnetic strip 102 on the first side 120 and a magnetic strip 104 on the second side 122. With the layer made of ferromagnetic material, the magnetic eyelash strips can be attached to the holders more securely. It is conceivable that the layer made of ferromagnetic material may also function as the marks for aligning the magnetic eyelash strips.

Fixed Holder

Figure 7B:
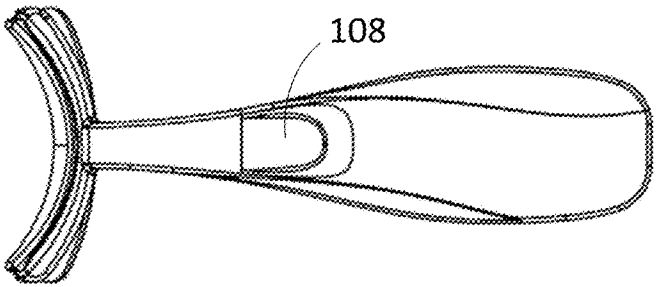
Figure 7C:
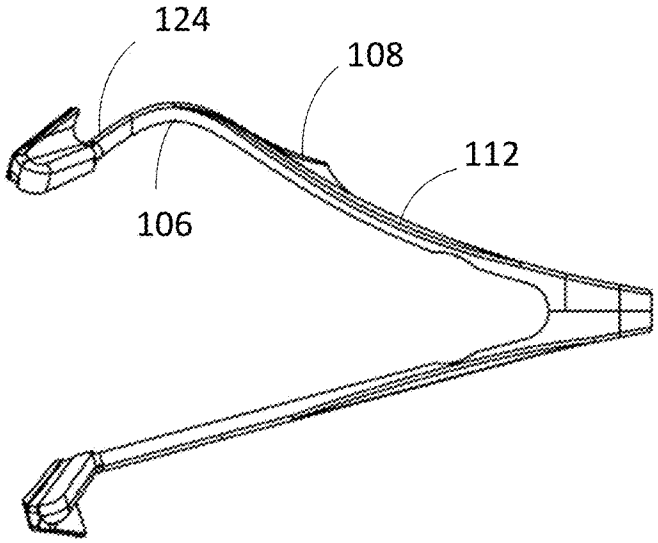
Figure 7A:
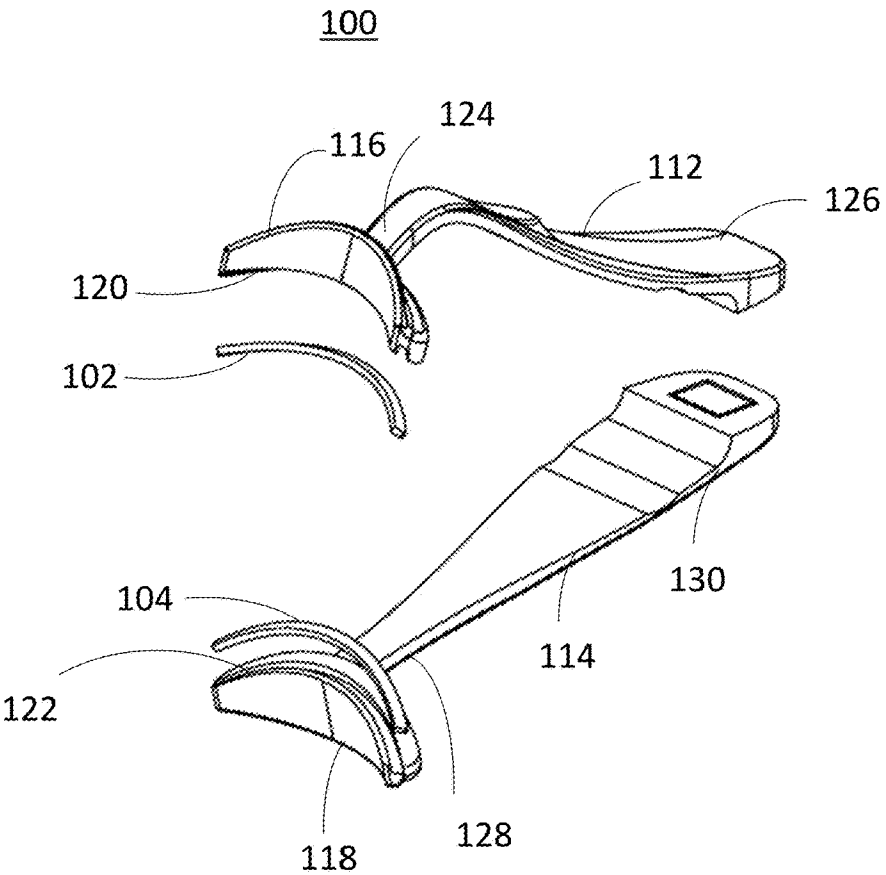

FIGS. 7A-7F depict another embodiment of the present invention. FIG. 7A depicts an exploded view, FIG. 7B depicts a top view, and FIG. 7C depicts a front view of the applicator 100.

As shown by FIG. 7A, the applicator 100 comprises a first leg 112 with a proximal end 126 and a distal end 124 and a second leg 114 with a proximal end 130 and a distal end 128. The applicator 100 further comprises a first holder 116 provided at the distal end 124 and a second holder 118 provided at the distal end 128.

The first holder 116 is fixed to the distal end 124 of the first leg 112, and the second holder 118 is fixed to the distal end 128 of the second leg 114. The holders 116 and 118 can be attached to the corresponding legs through molding, bonding, and welding, among the other. In this case, the structure of the applicator is simplified with less freedom for a user to adjust the holders.

Convex Leg

As shown in FIG. 7C, the first leg 112 comprises an outwardly convex section 106 at the vicinity of the distal end 124. It creates a larger space between the first and second holders 116 and 118, and provides more freedom in designing the angle of the first side 120 facing the second side 122. A protrusion 108 is provided on the outer surface of the first leg 112. When using the applicator 100, the user may put one or more fingers at the protrusion 108. In this embodiment, the second leg 114 does not comprise an outwardly convex section. However, in other embodiments, in replacement of or in addition to the convex section on the first leg, the second leg may comprise a convex section.

First and Second Sides

Figure 7E:
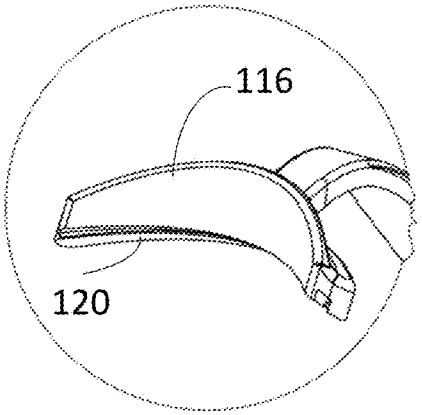
Figure 7F:
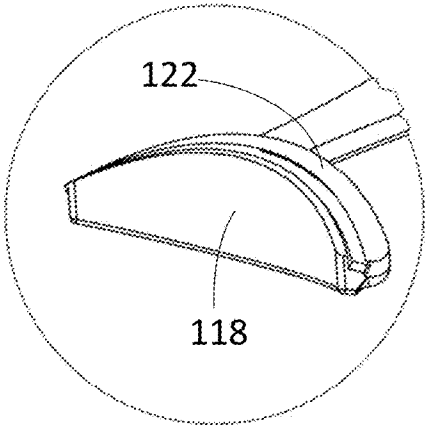
Figure 7D:
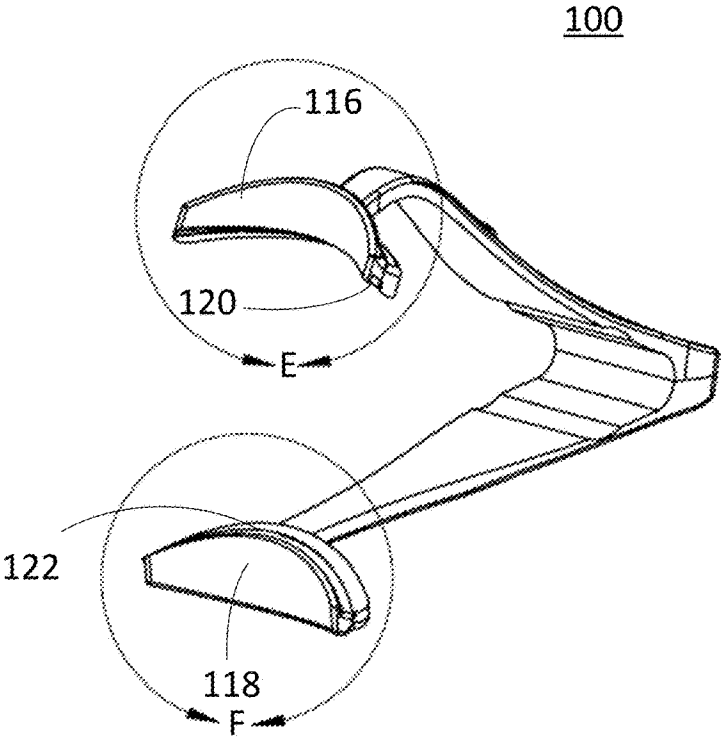

FIG. 7D depicts a perspective view of the applicator 100. FIG. 7E depicts a partial enlarged view of the circle E in FIG. 7D while FIG. 7F depicts a partial enlarged view of the circle F in FIG. 7D.

As shown in FIG. 7F, the second side 122 of the second holder 118 is curved corresponding to a natural lash line. The second side 122 is formed by a surface of the plate thus has a width larger than that of the second side 22 as shown in FIG. 1. The first side 120 may be similarly formed. In this case, if the holders are made of appropriate materials such as silicone, plastics, or metal, the flexibility of the holder also allows a user to adjust the first and second sides 120 and 122 to the shape of natural lash lines.

Fixed Attachment Between First and Second Legs

As shown in FIGS. 7A and 7C, the first legs 112 and the second leg 114 are fixed to each other at their proximal ends 126 and 130 through, for example, ultrasonic welding. Due to the flexibility of the structure and material of the legs themselves, the first leg 112 and the second leg 114 may pivot around the proximal ends 126 and 130, so that the applicator may switch between an open state as shown in FIG. 7C where the first side 120 and second side 122 are spaced and a closed state where the first side 120 and the second side 122 are in contact (not shown).

Hinge Between First and Second Legs

Figure 8B:
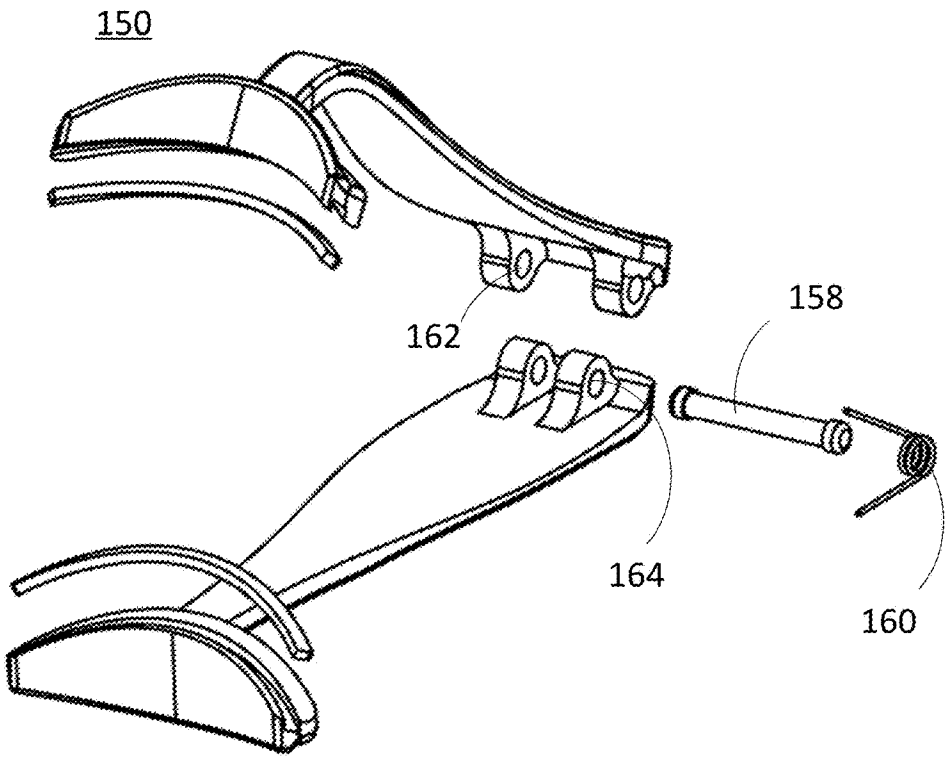
FIGS. 8A and 8B depict a perspective view and an exploded view of a further embodiment of the invention.
Figure 8A:
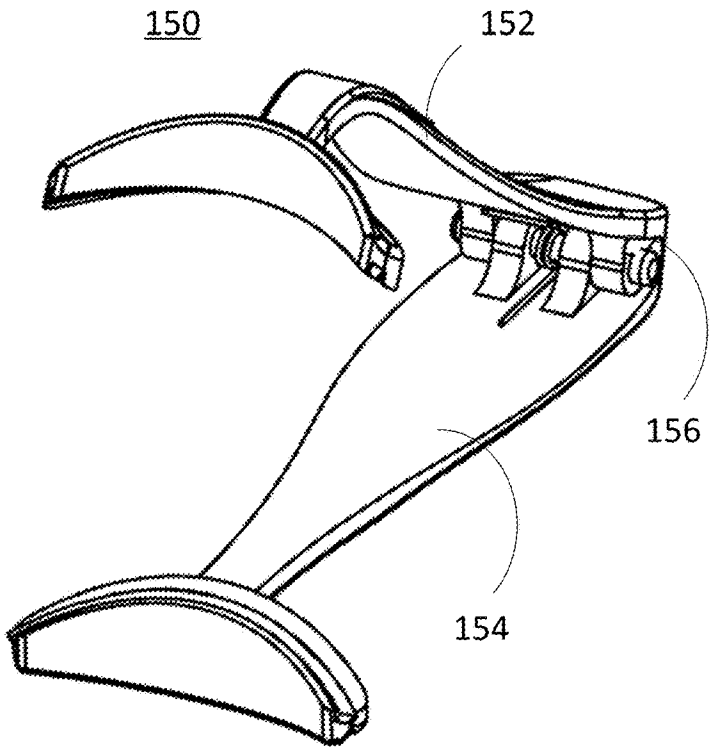

FIGS. 8A and 8B depict a further embodiment of the present invention. FIG. 8A depicts a perspective view and FIG. 8B depicts an exploded view of the applicator 150.

The first leg 152 and the second leg 154 are attached to each other through a hinge 156. As shown in FIG. 8B, the hinge 156 comprises a hinge rod 158, a torsion spring 160, two openings 162 provided on the first leg 152 and two openings 164 provided on the second leg 154. The hinge rod 158 goes through the openings 162, openings 164, and the center of the torsion spring 160 with the torsion spring 160 sandwiched between the first and second legs 152 and 154. Therefore, the first leg 152 and the second leg 154 are able to pivot around the hinge 160, so that the applicator 150 is switchable between an open state and a closed state.

Hinge Between Holder and Leg

Figure 9B:
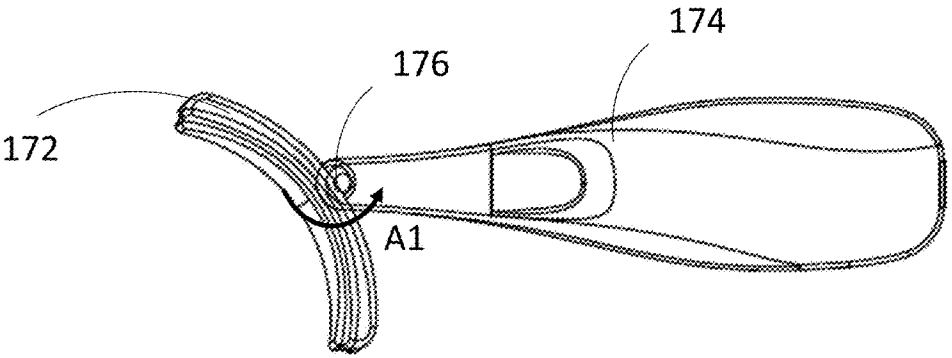
FIGS. 9A-9C depict top views of an additional embodiment of the present invention.
Figure 9C:
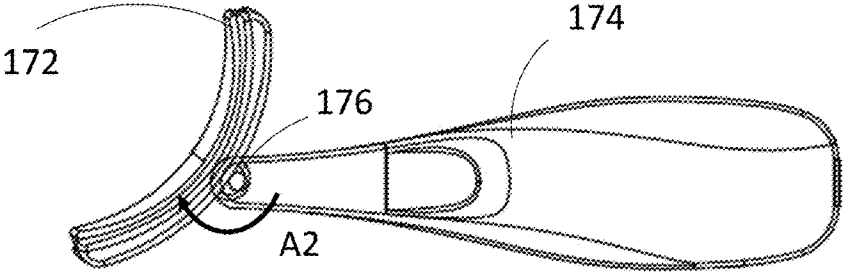
Figure 9A:
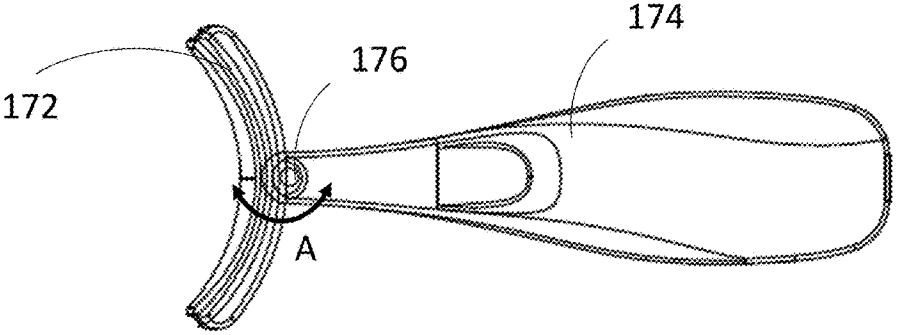

FIGS. 9A-9C depict top views of an additional embodiment of the invention.

FIGS. 9A-9C show a different structure of the holder from that shown in FIG. 1. In the embodiment as shown by FIG. 1, the holder 16 comprises a plate 40 and a bracket 38. One end of the bracket 38 is attached to the leg 12 through the hinge 24 while the other end of the bracket 38 is attached to the plate 40.

In the present embodiment, the first holder 172 does not comprise a bracket. The first holder 172 is a plate that attached to the first leg 174 through a hinge 176, so that the first holder 172 may pivot around the hinge 176 in the directions as shown by the arrow A. More specifically, the first holder 172 can be turned in the counterclockwise direction as shown by the arrow A1 in FIG. 9B or in the clockwise direction as shown by arrow A2 in FIG. 9C, so that the angular position of the first holder 172 relative to the first leg 174 can be adjusted, as needed by the user. The second holder and the second leg (not shown) can be similarly structured and attached to the second leg.

Sliding Holder

Figure 10B:
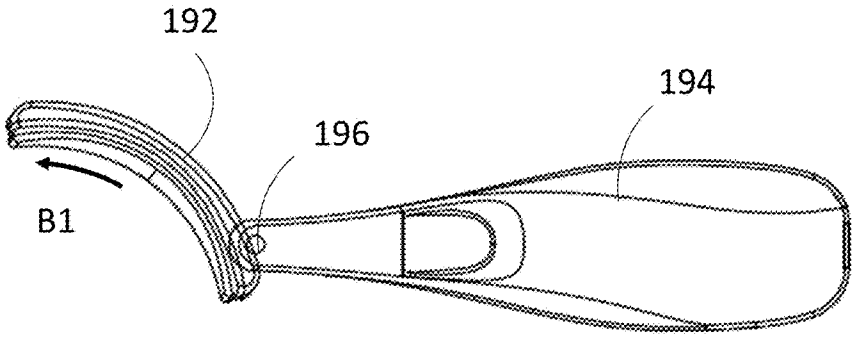
FIGS. 10A-10C depict top views of a further another embodiment of the invention.
Figure 10C:
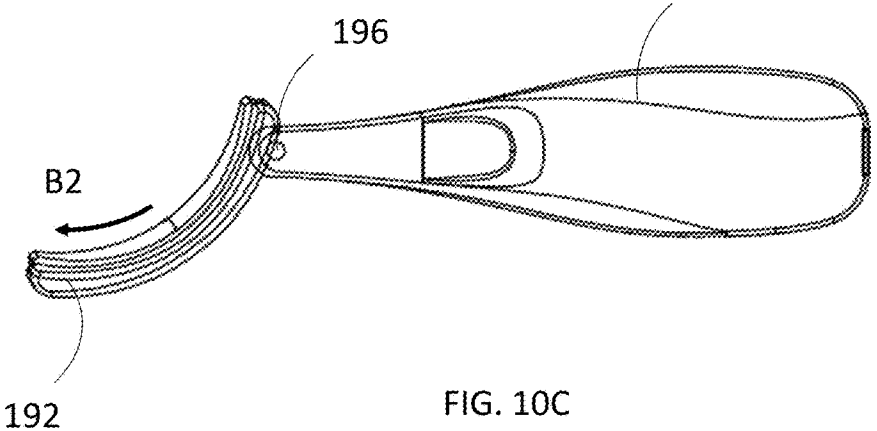
Figure 10A:
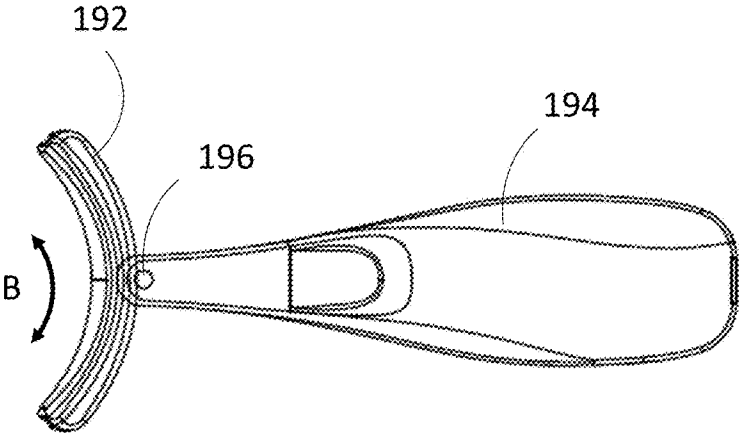

FIGS. 10A-10C depict top views of a further another embodiment of the invention. In the present embodiment, the first holder 192 is attached to the first leg 194 in a sliding manner. More specifically, the first leg 194 is provided with a pin 196 while the first holder 192 is provided a sliding groove (not shown) that is engaged with the pin 196 so that the pin 196 is able to slide within the sliding groove in the directions as shown by the arrow B. More specifically, the first holder 192 can be moved in the direction B1 as shown by FIG. 10B or in the direction B2 as shown by FIG. 10C, so that the angular position of the first holder 192 relative to the first leg 194 can be adjusted, as needed by the user. The second holder and the second leg (not shown) can be similarly structured and attached to the second leg.

In some other embodiments, the holders can be attached to the legs in a manner that allows both pivoting and sliding. For example, the first holder 16 in the applicator shown by FIG. 1 can be changed so that the plate 40 is engaged with the other end of the bracket 38 in a sliding manner. In addition, the hinge 176 in the applicator shown by FIG. 9A-9C can be engaged with a sliding groove provided in the holder 172 so that the hinge 176 is allowed to slide relative to the holder 172.

Grooves in Holders

Figure 11:
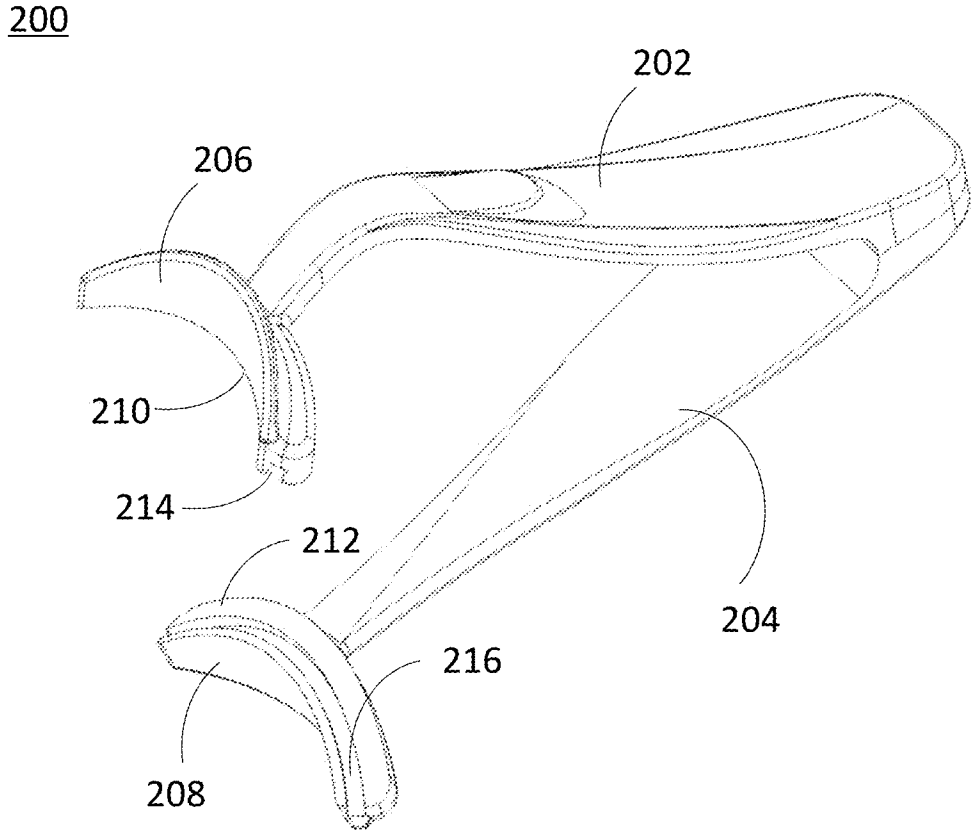
FIG. 11 depict a perspective view of an additional embodiment of the invention.

FIG. 11 depicts a perspective view of an additional further another embodiment of the invention. In the present embodiment, the first holder 206 comprises a first groove 214 provided in the first side 210 while the second holder 208 similarly comprises a second groove 216 provided in the second side 212 facing the first side 210. Each of the first and second grooves 214 and 216 extends through the whole length of corresponding one of the first and second sides 210 and 216. The grooves follow the geometric shape of the holder and are approximately 1 mm deep and 31 mm wide.

When applying the magnetic eyelash strips, a user can insert the magnetic eyelash strips into the corresponding grooves. The grooves 214 and 216 thus may increase the contact area of the holder with the magnetic eyelash strip and thus increase the friction force between the magnetic eyelash strip and the holder. The eyelash trip will not easily drop off the holder.

In one embodiment, the grooves receive a temporary adhesive fluid to keep the eyelash strips in place prior to their application by the end user. In another embodiment, the grooves are only slightly moistened to increase temporary surface adhesion of the eyelash strips to the grooves. The grooves are made using a milling process, in one embodiment. In another embodiment, the grooves are pre-fabricated in the corresponding sides of the holder.

In the embodiment shown in FIG. 11 the holders 206 and 208 are fixed to the legs 202 and 204. However, the holders may be connected to the legs through other means, such as hinges 34 and 36 as shown in FIGS. 1-5B and sliding connections such as the sliding groove 172 and pin 176 as shown in FIGS. 9A-9C.

In addition, to increase the security and stability of the attachment of the eyelash strips to the grooves, a layer made of ferromagnetic material can be provided within the grooves 214 and 216, just like the layers 82 and 84 shown in FIG. 6A, layer 92 and 94 shown in FIG. 6B, and layers 102 and 104 shown in FIG. 7A.

Although exemplary implementations of the invention have been depicted and described in detail herein, it will be apparent to those skilled in the relevant art that various modifications, additions, substitutions, and the like can be made without departing from the spirit of the invention and these are therefore considered to be within the scope of the invention as defined in the following claims.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions and types of materials described herein are intended to define the parameters of the invention, they are by no means limiting, but are instead exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the terms "comprising" and "wherein." Moreover, in the following claims, the terms "first," "second," and "third," are used merely as labels, and are not intended to impose numerical requirements on their objects. Further, the limitations of the following claims are not written in means-plus-function format and are not intended to be interpreted based on 35 U.S.C. § 112, sixth paragraph, unless and until such claim limitations expressly use the phrase "means for" followed by a statement of function void of further structure.

The embodiment of the invention in which an exclusive property or privilege is claimed is defined as follows:

1. An applicator comprising:

a first leg comprising a first proximal end and a first distal end;

a second leg comprising a second proximal and a second distal end;

a first holder provided at the first distal end and comprising a first side; and a second holder provided at the second distal end and comprising a second side facing the first side; wherein the first leg and the second leg are pivotally attached to each other so that the applicator is able to switch between an open state wherein the first side and the second side are spaced apart and a closed state wherein the first side and the second side are in contact;

the first side and second side are curved; and the first holder is provided with a first sliding groove extending along a direction in which the first side is curved along;

the first leg is provided with a first pin at the first distal end that is engaged with the first sliding groove so that the first holder is able to slide relative to the first leg;

the second holder is provided with a second sliding groove extending along a direction in which the second side is curved along; and the second leg is provided with a pin at the second distal end that is engaged with the second sliding groove so that the second holder is able to slide relative to the second leg.

2. The applicator of claim 1, wherein the first side is provided with a first groove and the second side is provided with a second groove;

the first groove extends along a whole length of the first side; and the second groove extends along a whole length of the second side.

3. The applicator of claim 2, wherein a first layer is provided in the first groove; and a second lay is provided in the second groove, wherein the first layer and second layer are made of a ferromagnetic material.

4. The applicator of claim 3, wherein the first layer comprises a first strip; and the second layer comprises a second strip.

5. The applicator of claim 4, wherein at least one of the first and second layers comprises one or more sections arranged on the corresponding one of the first and second side.

6. The applicator of claim 1, wherein the first holder and the second holder are transparent.

7. The applicator of claim 6, wherein the first holder and the second holder comprise silicone.

8. The applicator of claim 1, wherein a first mark is provided on the first holder; and a second mark is provided on the second holder.

9. The applicator of claim 8, wherein the first mark is provided on the first holder at a center position in an extending direction of the first side; and the second mark is provided on the second holder at a center position in an extending direction of the second side.

10. The applicator of claim 1, wherein the first side and the second side are adjustable in curvature.

11. The applicator of claim 1, wherein the first pin comprises a first hinge that allows the first holder to pivot; and the second pin comprises a second hinge that allows the second holder to pivot.

* * * * *